US009010437B2

(12) United States Patent
Galle, Jr.

(10) Patent No.: US 9,010,437 B2
(45) Date of Patent: Apr. 21, 2015

(54) SELF-ADJUSTING RISER CENTRALIZER

(71) Applicant: Edward M. Galle, Jr., Kingwood, TX (US)

(72) Inventor: Edward M. Galle, Jr., Kingwood, TX (US)

(73) Assignee: The Technologies Alliance, Inc., Houston, TX (US)

( * ) Notice: Subject to any disclaimer, the term of this patent is extended or adjusted under 35 U.S.C. 154(b) by 11 days.

(21) Appl. No.: 13/903,523

(22) Filed: May 28, 2013

(65) Prior Publication Data

US 2013/0312978 A1 Nov. 28, 2013

Related U.S. Application Data

(60) Provisional application No. 61/651,801, filed on May 25, 2012.

(51) Int. Cl.
*E21B 17/10* (2006.01)
*E21B 19/00* (2006.01)
*E21B 19/24* (2006.01)

(52) U.S. Cl.
CPC ..... *E21B 17/1057* (2013.01); *E21B 19/004* (2013.01); *E21B 19/24* (2013.01)

(58) Field of Classification Search
CPC .. E21B 17/1057; E21B 19/004; E21B 19/006
USPC ..... 166/355, 241.6; 405/224.2, 224.4
See application file for complete search history.

(56) References Cited

U.S. PATENT DOCUMENTS

| | | | | |
|---|---|---|---|---|
| 3,142,343 | A * | 7/1964 | Otteman et al. | 175/7 |
| 3,528,497 | A * | 9/1970 | Lehman | 166/360 |
| 3,605,415 | A * | 9/1971 | Mohlman | 114/264 |
| 4,136,633 | A * | 1/1979 | Homer et al. | 114/264 |
| 4,272,059 | A | 6/1981 | Noerager et al. | |
| 4,505,614 | A * | 3/1985 | Anschutz | 405/195.1 |
| 5,482,406 | A * | 1/1996 | Arlt, III | 405/195.1 |
| 5,950,737 | A | 9/1999 | Chou et al. | |
| 6,260,625 | B1 * | 7/2001 | Phan et al. | 166/355 |
| 6,601,531 | B1 * | 8/2003 | Baylot et al. | 114/264 |
| 6,672,804 | B1 * | 1/2004 | Hallot et al. | 405/224.4 |
| 7,329,070 | B1 | 2/2008 | Trent et al. | |
| 8,021,081 | B2 | 9/2011 | Crotwell et al. | |
| 2008/0031692 | A1 | 2/2008 | Wybro et al. | |
| 2008/0205992 | A1 | 8/2008 | Ellis et al. | |
| 2010/0147528 | A1 | 6/2010 | Baugh | |
| 2011/0170955 | A1 | 7/2011 | Koos et al. | |

* cited by examiner

*Primary Examiner* — Matthew Buck
(74) *Attorney, Agent, or Firm* — Bracewell & Giuliani LLP

(57) ABSTRACT

A riser tensioner assembly for supporting risers on an offshore drilling platform includes a frame assembly and a plurality of riser centralizers circumferentially spaced about the frame assembly. The riser centralizers each include a clevis supporting roller for bearing on a riser to limit lateral movement of the riser with respect to the frame assembly. The clevis includes an elongated channel along which the roller is movable to accommodate angular movement of the riser with respect to the frame assembly.

17 Claims, 8 Drawing Sheets

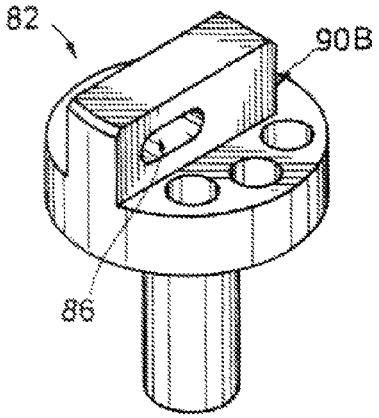
FIG. 10
FIG. 11
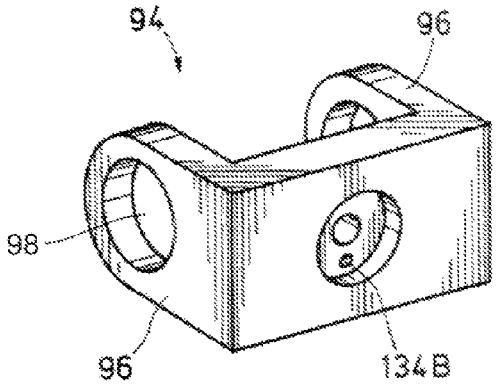
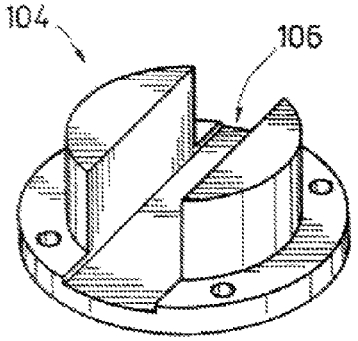
FIG. 12
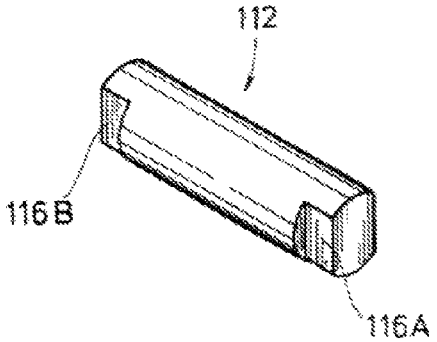
FIG. 13

SELF-ADJUSTING RISER CENTRALIZER

RELATED APPLICATION

This application is a non-provisional of and claims the benefit of and priority to U.S. Provisional Patent Application No. 61/651,801 titled "Self-Adjusting Riser Centralizer filed May 25, 2012, which is incorporated herein by reference in its entirety.

BACKGROUND

1. Field of Invention

The present invention relates generally offshore drilling and production systems, which are employed, e.g., for drilling and producing subsea oil or gas wells. In particular, the invention relates to systems for guiding and positioning risers on offshore drilling platforms by restricting lateral movement of the risers.

2. Description of Related Art

In one type of offshore system, a riser is connected between a subsea wellhead located on the sea floor and a drilling platform floating on the surface of the sea. In general, a riser is large diameter pipe used, e.g., to guide a drill string from the platform to the subsea wellhead and to provide a conduit through which drilling fluid may be circulated. Often, there is relative motion between the riser and the drilling platform since the subsea wellhead is not in exact alignment with the drilling platform, and since the drilling platform is subject to movement from wind and waves, while the riser is generally held stationary at the subsea wellhead.

It is important that relative movement between the platform and the riser, be limited to facilitate production and drilling operations, and to maintain clearance between the riser and other platform equipment. Throughout drilling and production operations, various pieces of equipment must be attached and detached from the riser. Thus movement of the platform relative to the riser may cause damage to the riser, the equipment attached to the riser, and the surrounding platform and platform equipment. Further, relative riser movement complicates the alignment and coupling of equipment which must be attached and detached from the riser.

Centralizing devices have been provided that constrain the lateral position of a riser relative to the platform. Some of these devices include rollers positioned circumferentially around the riser to guide longitudinal or vertical movements of the riser to facilitate drilling and production processes. Many of these centralizing devices, however, do not readily accommodate the unpredictable motion caused by waves, wind and other natural forces. Excessive loading can from these natural forces can cause the centralizing devices to prematurely wear and malfunction.

SUMMARY OF EMBODIMENTS OF THE INVENTION

In view of the foregoing, embodiments of the present invention provide a riser tensioner assembly or a riser centralizing assembly for supporting risers on an offshore drilling platform in a manner that accommodates motion caused by waves, wind and other natural forces. According to a first aspect of the disclosure, a riser centralizing assembly for limiting lateral movements of a riser with respect to a drilling platform includes a frame assembly adapted for mounting to the drilling platform. The frame assembly defines a longitudinal axis and is adapted for at least partially circumscribing the riser. A plurality of riser centralizers are circumferentially spaced about the longitudinal axis of the frame assembly, and each riser centralizer includes a housing coupled to the frame assembly and a roller assembly carried on the housing. The roller assembly includes a roller that is rotatable on an axle mounted to the housing such that the roller extends from a radially inner portion of the housing to bear on an exterior surface of the riser to limit lateral movement of the riser with respect to the frame assembly. The roller and axle are mounted to the housing for axial motion with respect to the housing in a direction generally parallel to the longitudinal axis of the frame assembly.

According to another aspect of the disclosure, a device for connecting a subsea wellhead to a drilling platform includes a riser adapted for connecting to the wellhead and a frame assembly adapted for mounting to the drilling platform. The frame assembly at least partially circumscribes the riser and defines a longitudinal axis. A plurality of rollers are supported by the frame assembly and radially spaced about the riser. The plurality of rollers are adjustable in a lateral direction with respect to the longitudinal axis and maintainable in a lateral position for bearing against the riser and limiting lateral movement of the riser with respect to the frame assembly. The plurality of rollers are movable in a longitudinal direction in response angular movement of the riser when the lateral position of the rollers is maintained. Thus, the rollers maintain contact with the riser when the riser moves from a first orientation where an axis of the riser is aligned with the longitudinal axis of the frame assembly to a second orientation where the axis of the riser is oblique to the longitudinal axis of the frame assembly.

According to another aspect of the disclosure, a riser tensioner assembly for supporting risers on an offshore drilling platform includes a frame assembly adapted for mounting to the drilling platform. The frame assembly includes a plurality of circumferentially spaced centralizer mounts for at least partially circumscribing an opening in the platform for a riser when the frame is mounted to the platform. The frame assembly defines a longitudinal axis. A plurality of riser centralizers are mounted to the plurality of circumferentially spaced centralizer mounts of the frame assembly, and each riser centralizer includes a housing fixedly coupled to the frame assembly. A clevis is supported by the housing. The clevis includes a base portion and pair of opposed legs extending from the base portion, and a pair of opposed elongated channels are defined within the pair of opposed legs of the clevis. A pair of sliding members are disposed at least partially within and movable through the a pair of elongated channels in a direction of elongation of the pair of elongated channels. An axle is coupled between the pair of sliding members, and a roller is mounted on the axle for rotation about the axle. The roller is movable in the direction of elongation in response to movement of the pair of sliding members through the pair of elongated channels.

BRIEF DESCRIPTION OF THE DRAWINGS

So that the maimer in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

FIG. 10 is a perspective view of a centralizer mount for use with the centralizer assembly of FIG. 9 in accordance with an embodiment of the present disclosure.

FIG. 11 is a perspective view of a clevis for use with the centralizer assembly of FIG. 9 in accordance with an embodiment of the present disclosure.

FIG. 12 is a perspective view of an end cap for use with the clevis of FIG. 11 in accordance with an embodiment of the present disclosure.

FIG. 13 is a perspective view of an axle for a roller for use with the centralizer assembly of FIG. 9 in accordance with an embodiment of the present disclosure.

DETAILED DESCRIPTION OF PREFERRED EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning well drilling, running operations, and the like have been omitted inasmuch as such details are not considered necessary to obtain a complete understanding of the present invention, and are considered to be within the skills of persons skilled in the relevant art.

Figure 1:
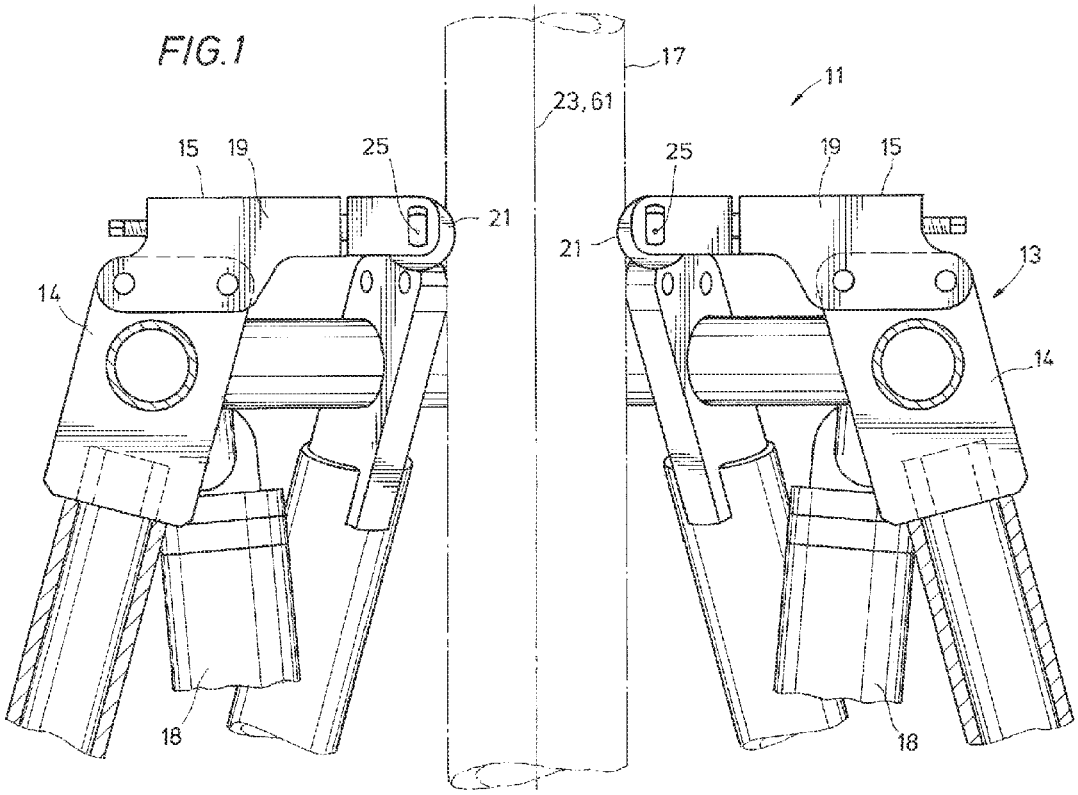
FIG. 1 is a partial sectional view of a riser tensioner assembly having a riser disposed therein in accordance with an embodiment of the present disclosure.

Referring FIG. 1, a riser tensioner assembly 11 includes a frame assembly 13 having a plurality of circumferentially spaced centralizer mounts 14 to which a plurality at riser centralizers 15 (two shown in FIG. 1) are coupled. The centralizer mounts 14 each include a pair of bores 37 for receiving fasteners and/or pins to couple the centralizers 15 to the frame 13 as described in greater detail below. In the embodiment depicted in FIG. 1, loads are transferred from the centralizers 15 to the frame assembly 13 through pins or bolts extending through the bores 37. An upwardly-facing planar surface 14B is defined on each of the centralizer mounts, which, in some embodiments, engages a downwardly facing planar surface on alternate embodiments of centralizers (not shown) for transferring loads to the frame assembly 13 as described in greater detail below.

In the embodiment illustrated in FIG. 1, riser tensioner assembly 11 is a pull up tensioner adapted to place a riser 17 in tension by pulling up on riser 17. The riser tensioner assembly 11 includes a plurality of tensioners 18 coupled to the frame assembly 13. The tensioners 18 are adapted to connect to the riser 17 such that a portion of the weight of the riser 17 is transferred through the tensioners 18 to the frame assembly 13 as understood by those skilled in the art. Riser tensioner assembly 11 mounts to a platform (not shown) on the surface of a body of water (not shown). Generally, the platform may be anchored in position on the body of water, allowing the platform to float over a subsea wellhead or well site (not shown). As the platform floats, it may move relative to the subsea well site, despite being anchored in position. The motion of the platform relative to the subsea well site may be vertical toward and away from the subsea well site, and horizontal toward and away from the subsea well site. Riser tensioner assembly 11 is mounted to the platform at a platform opening that is generally aligned with the subsea well site.

Riser 17 extends from the subsea well site to the platform so that fluids and tools may be transferred from the platform to a well at the subsea well site and from the well to the platform. Riser 17 will pass through riser tensioner assembly 11 at the opening in the platform so that riser tensioner assembly 11 may support riser 17. Riser 17 may extend above riser tensioner assembly 11 so that workers may have access to riser 17 or through riser 17 above riser tensioner assembly 11. Riser tensioner assembly 11 and frame assembly 13 include all necessary components to support riser 17 as is known in the art. A person skilled in the art will understand that riser tensioner assembly 11 may be any suitable type of riser tensioner that is adapted to place riser 17 in tension between the subsea well site and the surface platform on which riser tensioner assembly 11 is disposed. In an embodiment, cylinders (not shown) are coupled between riser 17 and frame assembly 13 to support riser 17 and hold it in tension between the subsea well site and the platform. Riser tensioner assembly 11 accommodates the relative motion between the platform and riser 17 caused by the floatation of the platform described above.

Riser centralizers 15 are mounted to frame assembly 13 and are adapted to limit lateral shift of riser 17 within frame assembly 13. Riser tensioner assembly 11 may include as many riser centralizers 15 as needed. In an embodiment, four riser centralizers 15 are used and placed circumferentially around riser tensioner assembly 11 so that each riser centralizer 15 is spaced ninety degrees from adjacent riser centralizers 15 and at the same axial location on riser tensioner assembly 11. A person skilled in the art will understand that more or fewer riser centralizers 15 may be used. Generally, riser centralizers 15 are horizontally coplanar, e.g., each riser centralizer 15 is disposed at the same axial position with respect to axis 23 of the frame assembly. A person skilled in the art will also understand that riser centralizers 15 may mount at a different axial location of frame assembly 13 than the axial position illustrated herein in FIGS. 1 and 5.

As shown in FIG. 1, each riser centralizer 15 includes a body portion 19 and a roller 21. During use of riser tensioner assembly 11, riser 17 may be positioned near a medial portion of riser tensioner assembly 11 so that riser 17 and riser tensioner assembly 11 are coaxial with an axis 23 of frame assembly 13. In an embodiment, an axis 61 of riser 17 is coaxial with axis 23 of frame assembly 13. Riser centralizers 15 may be positioned so that the roller 21 of each riser centralizer 15 is in contact with an exterior surface of riser 17. As discussed above, during use of the platform there may be relative motion between the platform and riser 17. As the platform to which riser tensioner assembly 11 is mounted moves relative to riser 17, riser 17 may move laterally closer to portions of frame assembly 13. To counteract this, and prevent contact between riser 17 and frame assembly 13 that may damage both, riser centralizers 15 resist lateral movement of riser 17 through contact between roller 21 and the exterior surface of riser 17. Rollers 21 extend from a radially inner portion of the riser centralizer to bear on an exterior surface of the riser 17. Rollers 21 may be free to rotate on an axis 25 in response to longitudinal motion of the riser 17 such that riser 17 may move vertically uninhibited by riser centralizers 15 or rollers 21.

Figure 2:
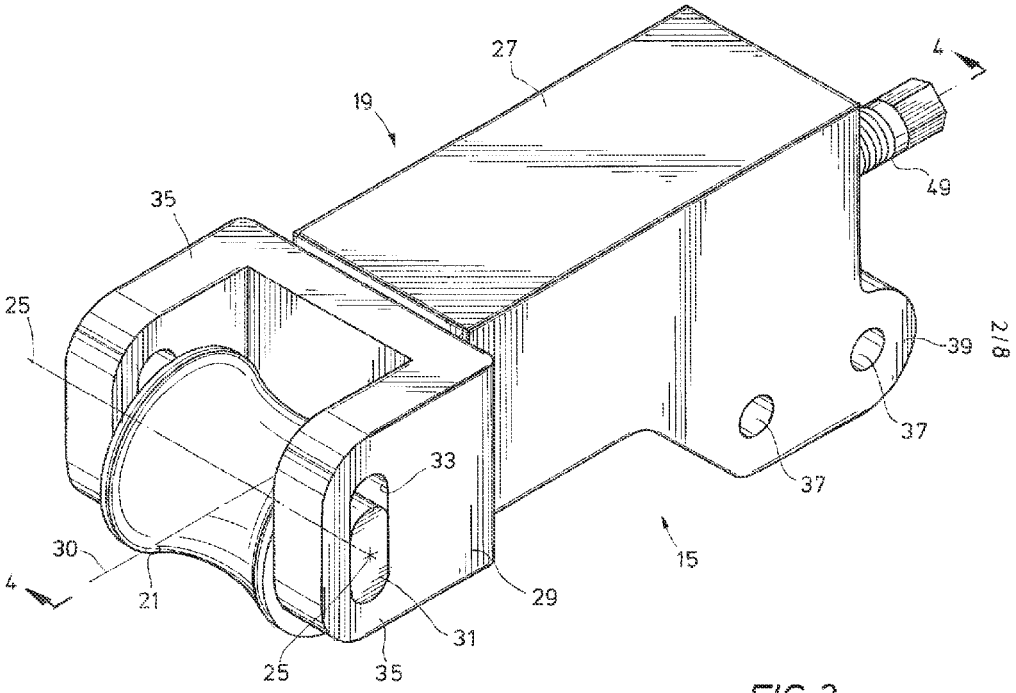
FIG. 2 is a perspective view of a riser centralizer of the riser tensioner assembly of FIG. 1 in accordance with an embodiment of the present disclosure.
Figure 3:
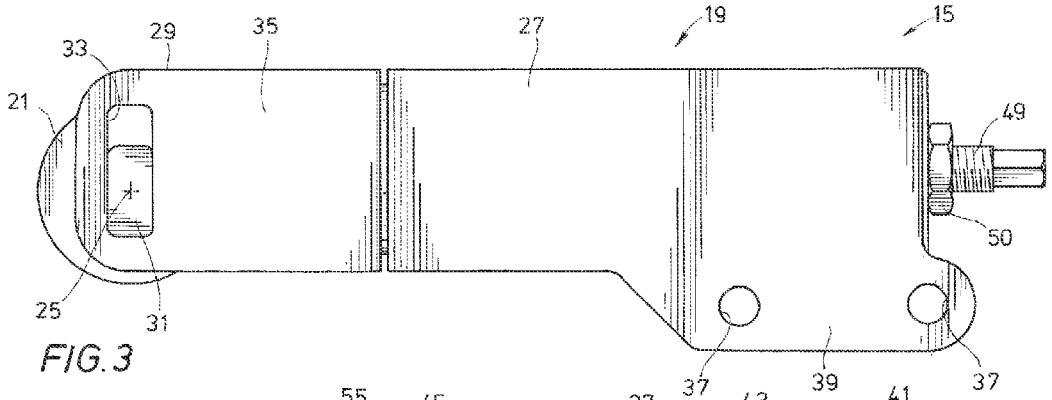
FIG. 3 is a left side elevation view of the riser centralizer of FIG. 2 in accordance with an embodiment of the present disclosure.

Referring to FIGS. 2-3, body portion 19 of each riser centralizer 15 includes a housing 27 and a clevis 29. The housing 27 defines a lateral housing axis 30. When the riser centralizer 15 is coupled to the frame assembly 13 (FIG. 1) the lateral housing axis 30 is substantially perpendicular to and intersects the axis 23 of the frame assembly 13. As used herein, terms such as "substantially perpendicular," or "generally parallel" are to be interpreted as one skilled in the at would interpret such terms. Roller 21 mounts to clevis 29 on an axle 51 (FIG. 4) that is coaxial with axis 25. Axle 51 of roller 21 mounts to a pair of opposed sliding members 31 disposed within elongated channels 33 formed in each leg 35 of clevis 29. In an embodiment, axle 51 and sliding members 31 are unitary, being formed of the same stock during the manufacturing process. In other embodiments, axle 51 and sliding members 31 are separate bodies that are mounted or otherwise secured to each other, for example by welding, after separate formation of each. In the illustrated embodiment, channels 33 are substantially rectangular, having a length in a direction of elongation perpendicular to axis 25 and parallel to axis 23 (FIG. 1) of frame assembly 13 when clevis 29 is in the position of FIGS. 1 and 2. Continuing to refer to FIGS. 2 and 3, sliding members 31 have a substantially rectangular shape having a length less than the length of channels 33. In an embodiment, the length of sliding members 31 is less than one-half the length of channel 33. In alternative embodiments, the length of sliding members 31 is greater than one-half the length of channels 33 but less than the fall length of channels 33. Sliding members 31 have a width substantially equivalent to a width of channels 33 so that sliding members 31 may fit within channels 33. The fit between sliding members 31 and channels 33 is such that sliding members 31 may translate through channels 33 parallel to axis 23 of FIG. 1, allowing roller 21 to move parallel to axis 23 relative to clevis 29 and body portion 19. In the illustrated embodiment, gravity will tend to bias roller 21 and sliding members 31 to the position of FIGS. 2 and 3, where sliding members 31 are located at a lower end of channels 33. In alternative embodiments, sliding members 31 may be supported on spring members (not shown) so that sliding members 31 are biased to a medial portion of channels 33 or an upper end of channels 33. Sliding members 31 are moveable through channels 33 and relative to channels 33 and clevis 29 from a primary position shown in FIG. 1 to a secondary position shown in FIG. 5. The sliding members 31, and thus the rollers 21, are movable between the primary and secondary positions in response to angular motion, e.g., tilting, of the riser 17 (FIGS. 1 and 5).

In the illustrated embodiment, housing 27 includes two bores 37 formed in a downwardly depending flange 39. Bores 37 are adapted to receive fasteners to mount housing 27, and consequently riser centralizer 15, to a member of frame assembly 13 having mating bores. In the illustrated embodiment, housing 27 includes two parallel flanges 39 on either side of housing 27. Each flange 39 includes two bores 37 are that are aligned with a corresponding bore 37 on the opposite flange 39. A person skilled in the art will recognize that riser centralizer 15 may be mounted to frame assembly 13 in any suitable manner, for example, by welding.

Figure 4:
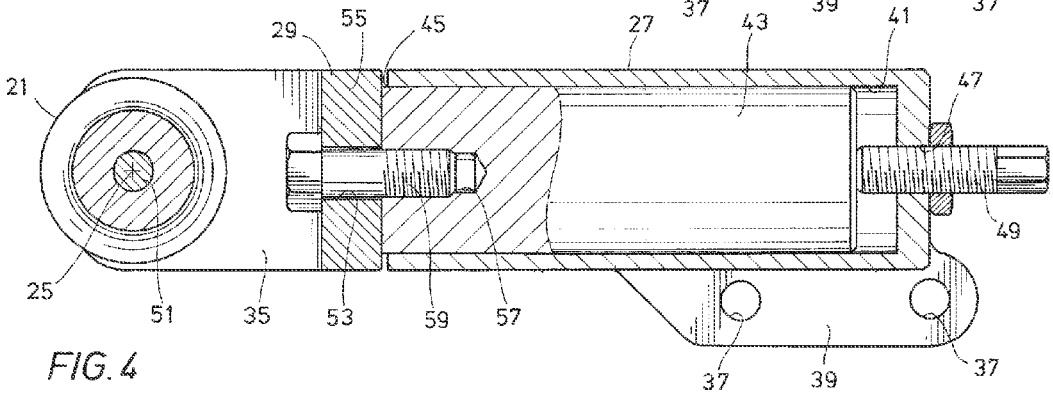
FIG. 4 is a sectional view of the riser centralizer of FIG. 2 taken along line 4-4 in accordance with an embodiment of the present disclosure.
Figure 5:
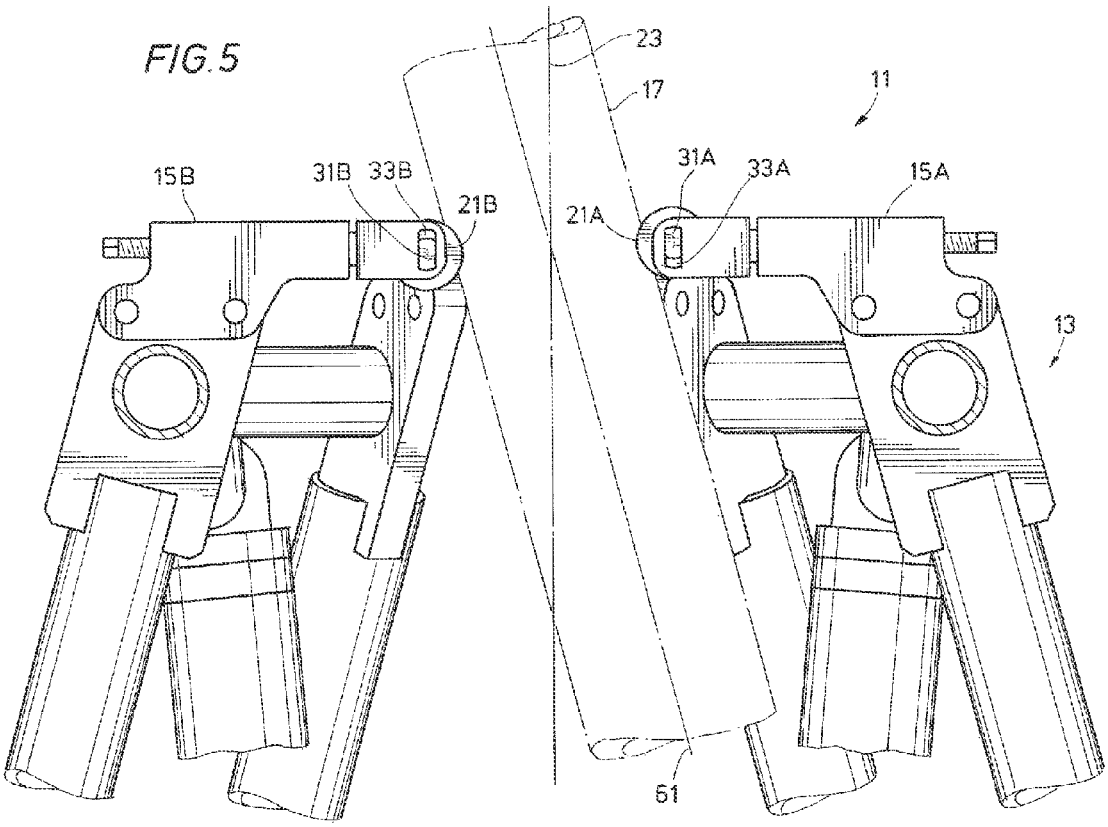
FIG. 5 is a partial sectional view of the riser tensioner assembly of FIG. 1 having the riser tilted relative to an axis of the riser tensioner assembly in accordance with an embodiment of the present disclosure.

Referring to FIG. 4, centralizer housing 27 defines a centralizer arm chamber 41 into which a centralizer am 43 may be inserted. Centralizer arm 43 passes through an opening 45 at an end of centralizer housing 27. Opening 45 has a diameter approximately equal to the diameter of centralizer arm 43. Centralizer arm 43 may move laterally within centralizer housing 27. Centralizer housing 27 may include wear rings (not shown) at opening 45 and within centralizer arm chamber 41 interposed between centralizer housing 27 and centralizer arm 43. The wear rings may comprise maintenance free low friction wear rings, or any other suitable wear element. The wear rings will reduce the wear on centralizer housing 27 and centralizer arm 43 during operation of riser centralizer 15, thereby extending the useful life of riser centralizer 15.

Centralizer housing 27 has an opening 47 opposite opening 45. Opening 47 has a diameter sufficient to accommodate passage of adjustment bolt 49, which is a component of an adjustment mechanism operable to selectively move the centralizer arm 43 along the housing axis 30. In the illustrated embodiment, opening 47 is threaded on an inner diameter of opening 47. Adjustment bolt 49 may thread into centralizer housing 27 through opening 47. An end of adjustment bolt 49 will abut an end of centralizer arm 43. Rotation of adjustment bolt 49 through the matching threads on adjustment bolt 49 and opening 47 will cause an end of adjustment bolt 49 to move alternatively into and out of centralizer housing 27. Adjustment bolt 49 may also thread through a jam nut 50 at opening 47 to prevent unintended rotation of adjustment bolt 49. The jam nut 50 thus serves as a locking mechanism that is operable to selectively maintain the lateral position of the centralizer arm 43 with respect to the housing 27. As adjustment bolt 49 moves into centralizer housing 27, it may force centralizer arm 43 partially out of centralizer housing 27 through the opening 47. When adjustment bolt 49 moves out of centralizer housing 27, centralizer arm 43 may be moved back further into centralizer housing 27. As described in greater detail below, the centralizer arm is 43 is coupled to the clevis 29 such that axial movement of the centralizer arm along the lateral housing axis 30, as induced by rotation of the adjustment bolt 49 through the threaded opening 47, induces axial movement of the clevis 29. Since a lateral position of the centralizer arm 43 within the housing 27 defines a lateral position of the roller 21 with respect to the longitudinal axis 23 of the frame assembly 13, roller 21 of clevis 29 may be brought into and maintained in contact with riser 17 (FIG. 1) after installation of riser centralizers 15. In addition, a lateral position of the roller 21 of each of the riser centralizers 15 may be adjusted as needed throughout the operative life of each riser centralizer 15.

Figure 6:
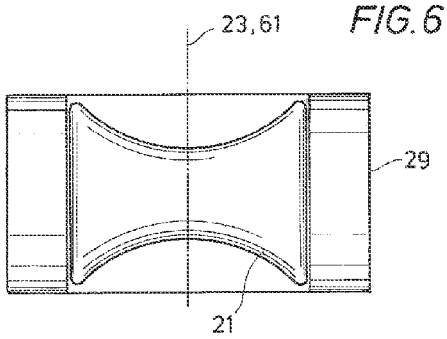
FIG. 6 is a front elevation view of the riser centralizer of FIG. 2 in accordance with an embodiment of the present disclosure.
Figure 7:
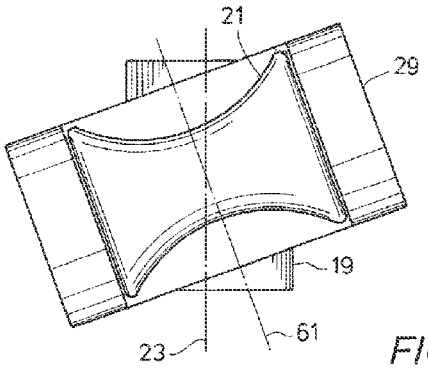
FIG. 7 is a front elevation view of the riser centralizer view of FIG. 2 having a clevis and roller of the riser centralizer tilted relative to an axis of the riser tensioner assembly in accordance with an embodiment of the present disclosure.

Each centralizer arm 43 and centralizer housing 27 includes a key (not shown) and a corresponding slot (not shown) in arm 43 configured to limit the range of rotation of centralizer arm relative to centralizer housing 27. Limiting the range of rotation of the centralizer arm 43 may serve to limit rotational movement of the roller 21 about the lateral housing axis 30 (FIG. 2) as illustrated in FIGS. 6 and 7. In addition, the key and the slot may be configured to limit the longitudinal travel of centralizer arm 43 relative to centralizer housing 27.

Roller 21 may comprise a "V" roller. As used herein a "V" roller refers to a roller having a curved concave profile. Rollers 21 may comprise a metallic sleeve or a metallic "V" shaped roller component surrounded with a urethane or rubber coating on an exterior surface thereof such that metal-to-metal contact is avoided when rollers 21 bear against the riser 17 (FIG. 1). Roller 21 will couple to clevis 29 through roller pin or central axle 51. A replaceable maintenance free low friction bushing may surround roller central axle 51 coupling clevis 29 to centralizer arm 43. Maintenance free washers may be interposed between roller 21 and clevis 29 to prevent wear of roller central axle 51 and clevis 29 during operation of the riser tensioner assembly 11. As discussed above, roller central axle 51 mounts or secures to sliding members 31 so that central axle 51 and sliding members 31 may translate as a single body.

Clevis 29 will further couple to centralizer arm 43, thereby securing centralizer clevis 29 to centralizer arm 43. In the illustrated embodiment, a fastener 59 passes through a bore 53 of a base portion 55 of clevis 29 and threads into a corresponding threaded bore 57 of centralizer arm 43. In this manner, clevis 29 mounts to centralizer arm 43 so that clevis 29 and roller 21 may be adjusted horizontally. Fastener 59 may be free of threads at base member 55 of clevis 29 so that clevis 29 may rotate on fastener 59 to accommodate movement of riser 17 relative to frame assembly 13, as described in more detail below.

Referring to FIG. 5, as the platform on which riser tensioner assembly 11 is mounted moves due to the effects of floatation on the body of water on which it is disposed, riser 17 will move relative to riser tensioner assembly 11. In the illustrated embodiment, riser 17 tilts relative to frame assembly 13 so that axis 23 of frame assembly 13 and axis 61 of riser 17 are at an angle to axis 23 of frame assembly 13. As riser 17 tilts from a vertical position, riser 17 will tilt toward one of the plurality of riser centralizers 15. In the illustrated embodiment, riser 17 tilts toward riser centralizer 15B and away from riser centralizer 15A. As riser 17 tilts, the portion of riser 17 between roller 21B and 21A increases, also increasing the amount of horizontal loading on riser centralizers 15A, 15B. In response to tilt toward riser centralizer 15B, roller 21A of riser centralizer 15A will be moved vertically by riser 17 through channel 33 from the primary position illustrated in FIGS. 1-3, to the secondary position illustrated in FIG. 5 where sliding member 31 is at the upper end of channel 33. This increases the effective horizontal spacing between rollers 21A and 21B, accommodating the increase in the portion of riser 17 between riser centralizers 15. This eliminates the effect of any increase in loading on riser centralizers 15 while still maintaining contact between rollers 21A and 21B and the surface of riser 17. In this manner, the total loading on riser centralizers 15 is reduced, prolonging the life of riser centralizers 15 without risking damage to riser 17 due to stress of impact loading.

As shown in FIGS. 6-7, when the riser 17 (FIG. 5) tilts, the rollers 21 of riser centralizers 15 mounted in positions that are oriented 90 degrees in the horizontal plane from riser centralizers 15A and 15B (FIG. 5) are induced to rotate on fastener 59 (FIG. 4) about a the lateral housing axis 30 or about an axis substantially parallel to the housing axis 30. In this manner, riser centralizers 15 again maintain contact with riser 17 as riser 17 tilts from a coaxial orientation with respect to axis 23 to an oblique orientation with respect to the axis 23.

Figure 8:
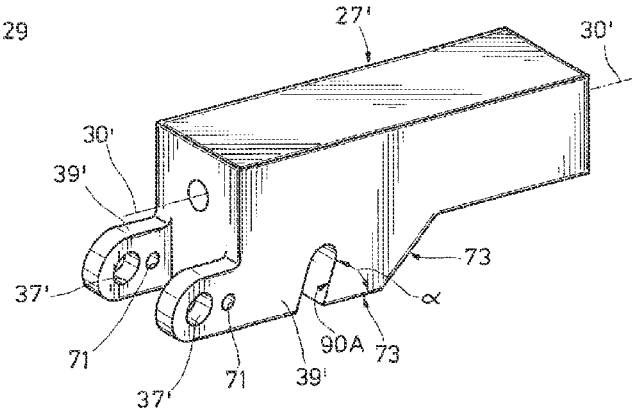
FIG. 8 is a perspective view of a housing for a riser centralizer in accordance with an alternate embodiment of the disclosure.
Figure 9:
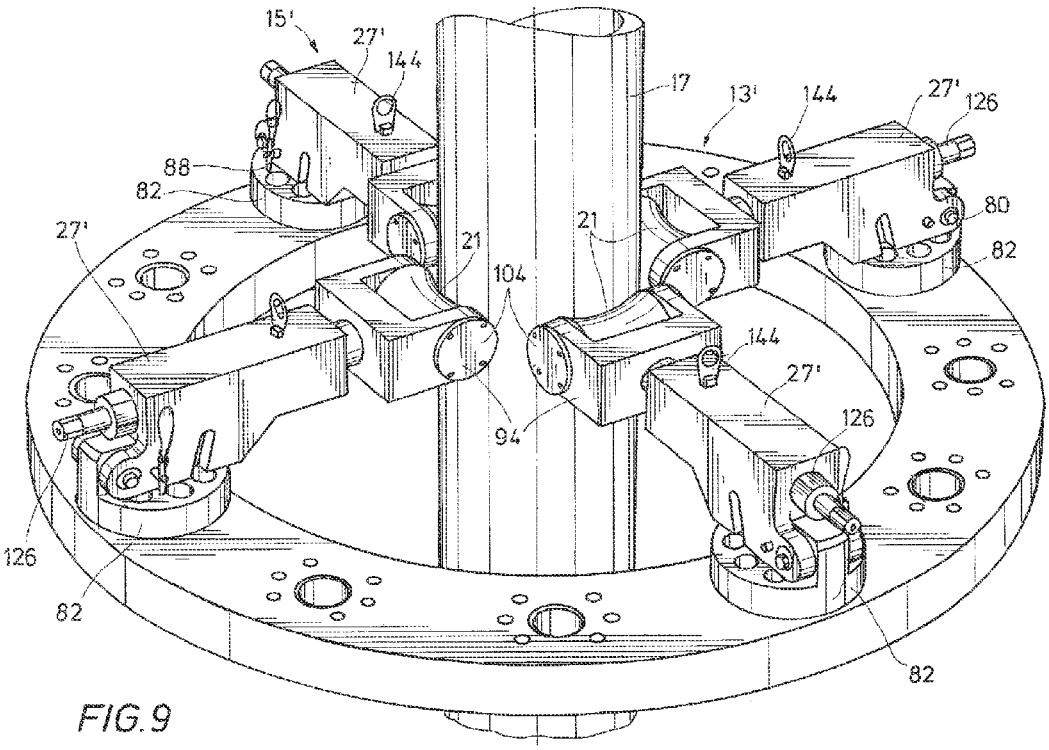
FIG. 9 is a perspective view of a centralizer assembly having the riser disposed therein in accordance with an alternate embodiment of the present disclosure.

Referring to FIGS. 8 through 10, in an alternative embodiment of a centralizer assembly 11' (FIG. 9), a centralizer housing 27' (FIG. 8) includes all the components of centralizer housing 27 described above, modified as described below. Centralizer housing 27' includes a bore 37' formed in a downwardly depending flange 39'. Bore 37' extends in a direction substantially perpendicular to a housing axis 30' defined by the housing 27', and is adapted to receive a fastener 80 (FIG. 9) to mount housing 27' to a centralizer mount 82 (FIG. 9) of frame assembly 13' (FIG. 9) having a corresponding mating bore or slot 86. In the illustrated embodiment, housing 27' includes two parallel flanges 39' on either side of housing 27'. Each flange 39' includes a bore 37' aligned with the corresponding bore 37' on the opposite flange 39'. A pin bore 71 is formed in flange 39' adjacent bore 37'. In the illustrated embodiment pin bore 71 is smaller than bore 37'. When bore 37' is aligned with a mating bore or slot 86 of frame assembly 13', pin bore 71 will align with a corresponding pin bore or slot 86 of frame assembly 13'. In the illustrated embodiment, housing 27' may swivel on the fastener 80 passed through bores 37' and the mating bores or slots 86 of frame assembly 13. This swiveling facilitates installation of the riser 17 since one or more of the centralizers 15' is operable to swivel on the fastener 80 to provide additional space for maneuvering riser 17 into position. A pin 88 may be inserted into pin bore 71 and the mating pin bore or slot 86 of frame assembly 13' when housing 27' is appropriately positioned for restriction of lateral movement by riser 17. When the pin is inserted into pin bore 71 and the mating pin bores or slots 86 of frame assembly 13', housing 27' will be restricted from swiveling or pivoting about the fastener 80 passed through bores 37' and the mating bores of frame assembly 13. A person skilled in the art will recognize that the pin 88 may be passed into pin bore 71 without the need for special tools, threading, or similar input, permitting housing 27' to be secured to frame assembly 13' more quickly, and released to permit pivoting on the fastener 80 passed through bores 37' more quickly.

Still further, housing 27' includes a solid tapered portion 73 having a planar lower end 75 that may abut with frame assembly 13'. Planar lower end 75 extends laterally across the housing 27' with respect to the housing axis 30'. A first angled abutting surface 90A is provided on the housing 27' which abuts a second angled abutting surface 90B (FIG. 10) on the centralizer mount 82 of frame assembly 13'. The first angled abutting surface 90A is steeply angled with respect to the planar lower end 75. In some embodiments, an angle $\alpha$ in the range of about 70 to about 80 degrees is defined between the first angled abutting surface 90A and the planar lower end 75. In other embodiments the angle $\alpha$ is about 75 degrees. The term "about" here should be interpreted as one skilled in the art would interpret the term, including for example at least a 1 degree tolerance. The angle $\alpha$ provides a surface area for transfer of horizontal and vertical loads from riser centralizers 15' through housing 27' into frame assembly 13'. Tapered portion 73 extends from a portion of housing 27' that extends adjacent to riser 17 to the load bearing second abutting surface 90B of frame assembly 13' so that horizontal loading of housing 27' that may induce shear loads in frame assembly 13 may be directed into compressive loading of frame assembly 13.

Referring now to FIGS. 11-13 various components of centralizers 15' are depicted. A clevis 94 includes a pair of opposed legs 96, which each define an opening 98. The openings 98 are sized to receive an end cap 104. The end caps 104 define an elongated slot 106, which can be oriented in a direction parallel to a longitudinal axis 110 of frame assembly 13' (FIG. 9) when the end cap 104 is received in the openings 98. An axle 112 includes sliding members 116A and 116B on opposed ends thereof for moving through the elongated channels 106 in response to angular movement of riser 17 as described above. In the embodiment depicted, the sliding members 116A and 116B are flattened ends of the axle 112 integrally constructed therewith.

Figure 14A:
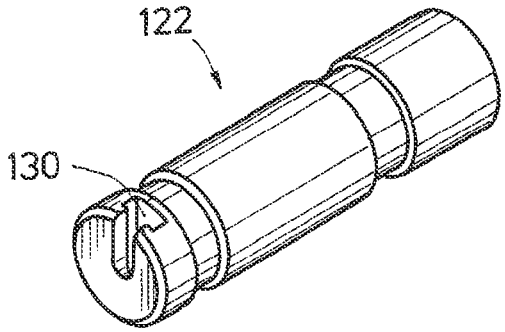
FIGS. 14A and 14B are perspective views of a centralizer arm for use with the centralizer assembly of FIG. 9 in accordance with an embodiment of the present disclosure.
Figure 14B:
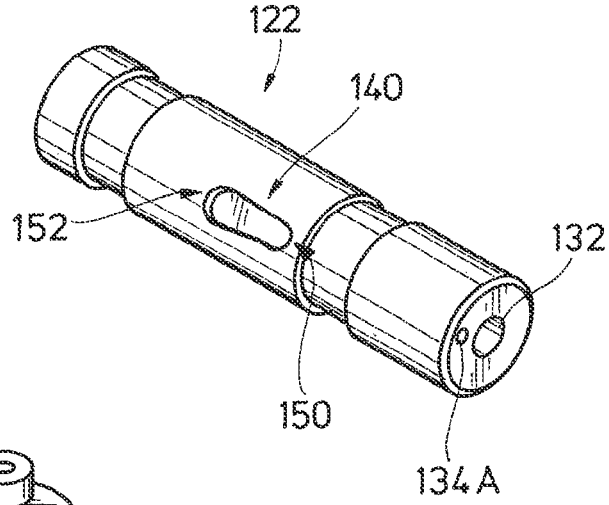
Figure 15:
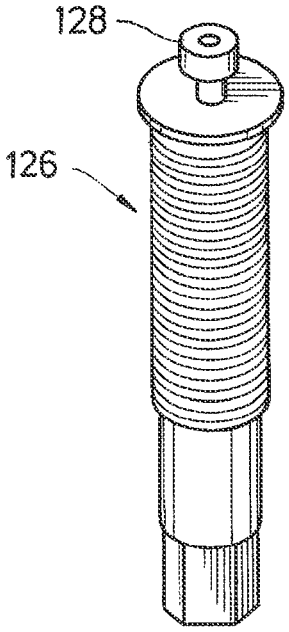
FIG. 15 is a perspective view of an adjustment bolt for use with the centralizer assembly of FIG. 9 in accordance with an embodiment of the present disclosure.

Referring now to FIGS. 14A, 14B and 15, a centralizer arm 122 and an adjustment bolt 126 are depicted. The adjustment bolt 126 includes a protrusion 128 on an end thereof, which is received within a T-shaped slot 130 of the centralizer arm. The protrusion 128 permits longitudinal or linear motion of the adjustment bolt 126 to be transmitted to the centralizer arm 122, while permitting independent rotation of the centralizer arm 122 and adjustment bolt 126. The centralizer arm 122 includes a threaded hole 132 on an end opposite the T-shaped slot 130 for receiving a fastener (not shown) to couple the centralizer arm 122 to the clevis 94 (FIG. 11). A pin hole 134A is also provided on the centralizer arm 122 to receive an alignment pin (not shown) which extends into a corresponding hole 134B on the clevis 94, such that the rotational position of the clevis 94 with respect to the centralizer arm is maintained. Thus, in the embodiment depicted, the clevis 94 and the centralizer arm 122 rotate together in response to angular movement of riser 17 as described above.

A slot 140 is defined on an upper surface of the centralizer arm 122. The slot 140 interfaces with an interference pin 144 (FIG. 9) to limit a rotational range of the centralizer arm 122 in a variable manner. The slot includes a relatively narrow end 150 and a relatively broad end 152. The relatively narrow end 150 is positioned to engage the interference pin 144 when centralizer arm is 122 in radially outward position, and the relatively broad end 152 is positioned to engage the interference pin 144 when centralizer arm 122 is in radially inward position within the housing 27' (FIG. 8). Thus, the centralizer arm 122 will have a greater range of rotational motion when the centralizer arm 122 is adjusted to an extended position than when centralizer arm 122 is adjusted to a retracted position. In some embodiments, the relatively narrow end 150 is sized to prohibit substantially all of the rotational motion of the centralizer arm 122 when the centralizer arm is adjusted to a retracted position, e.g., by the adjustment bolt 126.

Accordingly, the disclosed embodiments provide numerous advantages. For example, the disclosed embodiments provide a riser tensioner assembly that may maintain a riser centralized within the riser tensioner frame assembly while accommodating tilt of the riser. In addition, the disclosed embodiments provide riser centralizers that may be formed of lighter materials. Still further, the disclosed embodiments place less stress on both the riser and tensioner frame while maintaining the proper alignment of the riser within the tensioner prolonging the useful life of both.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A riser centralizing assembly for limiting lateral movements of a riser with respect to a drilling platform, the riser centralizing assembly comprising:

a frame assembly adapted for mounting to the drilling platform, the frame assembly adapted for at least partially circumscribing the riser and defining a longitudinal axis; and a plurality of riser centralizers circumferentially spaced about the longitudinal axis of the frame assembly, each riser centralizer comprising:

a housing coupled to the frame assembly; and a roller assembly carried on the housing, the roller assembly comprising a roller rotatable on an axle mounted to an elongated hole in the riser centralizer, wherein the roller extends from a radially inner portion of the housing to bear on an exterior surface of the riser to limit lateral movement of the riser with respect to the frame assembly, and wherein the hole has a greater dimension than the axle in a direction generally parallel to the longitudinal axis of the frame assembly, and the axle is free to move linearly within the hole parallel to the longitudinal axis of the frame assembly when the riser tilts relative to the longitudinal axis of the frame assembly.

2. A riser centralizing assembly according to claim 1, wherein each riser centralizer further comprises a clevis mounted to the housing, wherein the clevis includes a base portion and pair of opposed legs extending from the base portion, wherein the hole comprises a pair of channels, each of the channels located in one of legs, and wherein the axle extends between the opposed legs of the clevis.

3. A riser centralizing assembly according to claim 2, wherein the hole comprises a pair of elongated channels in the pair of opposed legs of the clevis, and wherein the axle is coupled to a pair of sliding members at least partially disposed within the pair of elongated channels such that the sliding members are movable along the elongated channels to move the roller and the axle in the direction generally parallel to the longitudinal axis of the frame assembly.

4. The riser centralizing assembly according to claim 2, wherein each riser centralizer further comprises a centralizer arm adjustable within the housing along a housing axis that is on a radial line of the longitudinal axis of the frame assembly, and wherein the clevis of each riser centralizer is mounted to the centralizer arm such that a lateral position of the centralizer arm within the housing defines a lateral position of the roller with respect to the longitudinal axis of the frame assembly.

5. The riser centralizing assembly according to claim 4, wherein each riser centralizer further comprises an adjustment mechanism operable to selectively adjust the centralizer arm along the housing axis and a locking mechanism operable to selectively maintain the lateral position of the centralizer arm with respect to the housing.

6. The riser centralizing assembly according to claim 4, wherein the housing is coupled to the frame assembly by a pivot pin that enables the housing to be selectively pivoted upward about the pivot pin relative to the frame assembly.

7. The riser centralizing assembly according to claim 2, wherein the clevis is mounted to the housing such that the clevis is freely rotatable about a radial line extending from the longitudinal axis of the frame assembly.

8. The riser centralizing assembly according to claim 4, wherein the clevis is rotatable with respect to the housing about the housing axis, and is mounted to the centralizer arm for movement along the housing axis when the centralizer arm is adjusted along the housing axis.

9. A riser centralizing assembly for limiting lateral movements of a riser with respect to a drilling platform, the riser centralizing assembly comprising:

a frame assembly adapted for mounting to the drilling platform, the frame assembly updated for at least partially circumscribing the defining a longitudinal axis; and a plurality of riser centralizers circumferentially spaced about the longitudinal axis of the frame assembly, each riser centralizer comprising;

a housing coupled to the frame assembly;

a roller assembly carried on the housing, the roller assembly comprising a roller rotatable on an axle mounted to the housing, wherein the roller extends from a radially inner portion of the housing to bear on an exterior surface of the riser to limit lateral movement of the riser with respect to the frame assembly, and wherein the roller and axle are mounted for axial motion with respect to the housing in a direction generally parallel to the longitudinal axis of the frame assembly; and wherein the housing comprises at least one downwardly depending flange including a first bore extending therethrough for receiving a first fastener to couple the housing to the frame assembly, the first bore extending in a direction substantially perpendicular to a housing axis defined by the housing.

10. The riser centralizing assembly according to claim 9, wherein the at least one downwardly depending flange further includes a second bore extending therethrough, the second bore spaced from the first bore such that the housing will be restricted from swiveling or pivoting about the first bore when a second fastener is received in the first bore and the housing is coupled to the frame assembly.

11. The riser centralizing assembly according to claim 9, wherein the housing further comprises an angled surface with respect to a planar lower end of the housing for abutting a the frame assembly for transferring loads thereto.

12. A device for connecting a subsea wellhead to a drilling platform, the device comprising:

a riser adapted for connecting to the wellhead;

a frame assembly adapted for mounting to the chilling platform, the frame assembly at least partially circumscribing the riser and defining a longitudinal axis; and a plurality of rollers supported by the frame assembly and radially spaced about the riser, the plurality of rollers adjustable in a lateral direction with respect to the longitudinal axis and maintainable in a lateral position for bearing against the riser and limiting lateral movement of the riser with respect to the frame assembly;

wherein the plurality of rollers are movable in a longitudinal direction in response to angular movement of the riser when the lateral position of the rollers is maintained, such that the rollers maintain contact with the riser when the riser moves from a first orientation where an axis of the riser is aligned with the longitudinal axis of the frame assembly to a second orientation where the axis of the riser is oblique to the longitudinal axis of the frame assembly; and a plurality of clevises mounted to the frame assembly, wherein each of the clevises includes a pair of opposed legs extending from a base portion, and wherein an axle of each of the rollers is movable along at least one elongated channel defined in the pair of opposed legs.

13. The device according to claim 12, wherein each of the rollers is rotatable about a lateral axis that is generally perpendicular to and intersecting the longitudinal axis of the frame assembly in response to angular movement of the riser with respect to the frame assembly.

14. The device according to claim 12, wherein the axle is biased to a lower end of the at least one elongated channel.

15. The device according to claim 12, wherein the plurality of rollers include at least one pair of opposed rollers wherein lateral adjustment of the pair of opposed rollers toward and away from one another varies the spacing between the pair of opposed rollers.

16. A riser tensioner assembly for supporting risers on an offshore drilling platform, the riser tensioner assembly comprising:

a frame assembly adapted for mounting to the drilling platform, the frame assembly including a plurality of circumferentially spaced centralizer mounts for at least partially circumscribing an opening in the platform for a riser when the frame is mounted to the platform, the frame assembly defining a longitudinal axis; and a plurality of riser centralizers mounted to the plurality of circumferentially spaced centralizer mounts of the frame assembly, each riser centralizer comprising:

a housing fixedly coupled to the frame assembly;

a clevis supported by the housing, the clevis comprising a base portion and pair of opposed logs extending from the base portion, wherein a pair of opposed elongated channels are defined within the pair of opposed legs of the clevis;

a pair of sliding members disposed at least partially within and movable through the a pair of elongated channels in a direction of elongation of the pair of elongated channels;

an axle coupled between the pair of sliding members; and a roller mounted on the axle for rotation about the axle, the roller movable in the direction of elongation in response to movement of the pair of sliding members through the pair of elongated channels.

17. The riser tensioner assembly according to claim 16, further comprising at least one tensioner coupled to the frame, the at least one tensioner adapted to connect to the riser such that a weight of the riser is transferred through the tensioner to the frame assembly.

* * * * *